United States Patent [19]

Hardt

[11] Patent Number: 4,811,536

[45] Date of Patent: Mar. 14, 1989

[54] OUTER WALL STRUCTURE FOR BUILDINGS

[76] Inventor: William G. Hardt, Rte. 4, Box 2270, Lake Geneva, Wis. 53147

[21] Appl. No.: 406,573

[22] Filed: Aug. 9, 1982

[51] Int. Cl.[4] ..... E04B 1/00

[52] U.S. Cl. ..... 52/250; 52/282; 52/295; 52/405; 52/606

[58] Field of Search ..... 52/405, 295, 293, 606, 52/224, 253, 251, 250, 587, 583, 282

[56] References Cited

U.S. PATENT DOCUMENTS

| | | | |
|---|---|---|---|
| 1,361,831 | 12/1920 | Crew | 52/587 X |
| 1,892,225 | 12/1932 | Venzie | 52/587 X |
| 2,924,962 | 2/1960 | Nettle | 52/293 |
| 3,503,165 | 3/1970 | Hardt | 52/293 X |
| 3,566,560 | 3/1971 | Wakefield et al. | 52/251 X |
| 3,762,115 | 10/1973 | McCaul, III et al. | 52/295 X |
| 3,785,095 | 1/1974 | Veiner | 52/583 X |
| 3,842,558 | 10/1974 | Scholz et al. | 52/293 |

*Primary Examiner*—Carl D. Friedman

*Attorney, Agent, or Firm*—Niro, Scavone, Haller, Niro & Rockey, Ltd.

[57] ABSTRACT

A building, the outer walls of which are formed of prefabricated panels of cementitious material having hollow sections extending substantially continuously throughout the height of the panels in closely spaced apart relation, and a footing adapted to enable the panels to be mounted thereon with means for securing the panels onto the footing, and to each other, to provide a strong, sturdy and inexpensive assembly of outer building walls.

9 Claims, 2 Drawing Sheets

OUTER WALL STRUCTURE FOR BUILDINGS

OBJECTS OF THE INVENTION

It is an object of this invention to provide a strong and sturdy assembly of light weight, prefabricated cementitious panels which can be mounted onto prepared footings to provide easily assembled and structurally strong outer building walls in the fabrication of low cost buildings.

It is another object of this invention to produce and to provide a method for producing pre-fabricated hollow wall panels of cementitious material which embody means for easy assembly into low cost, strong and attractive walls in the construction of housing and other buildings.

BRIEF DESCRIPTION OF THE DRAWINGS

These and other objects and advantages of this invention will hereinafter appear and, for purposes of illustration, but not of limitation, an embodiment of the invention is shown in the accompanying drawings, in which.

DETAILED DESCRIPTION OF THE INVENTION

Figure 1:
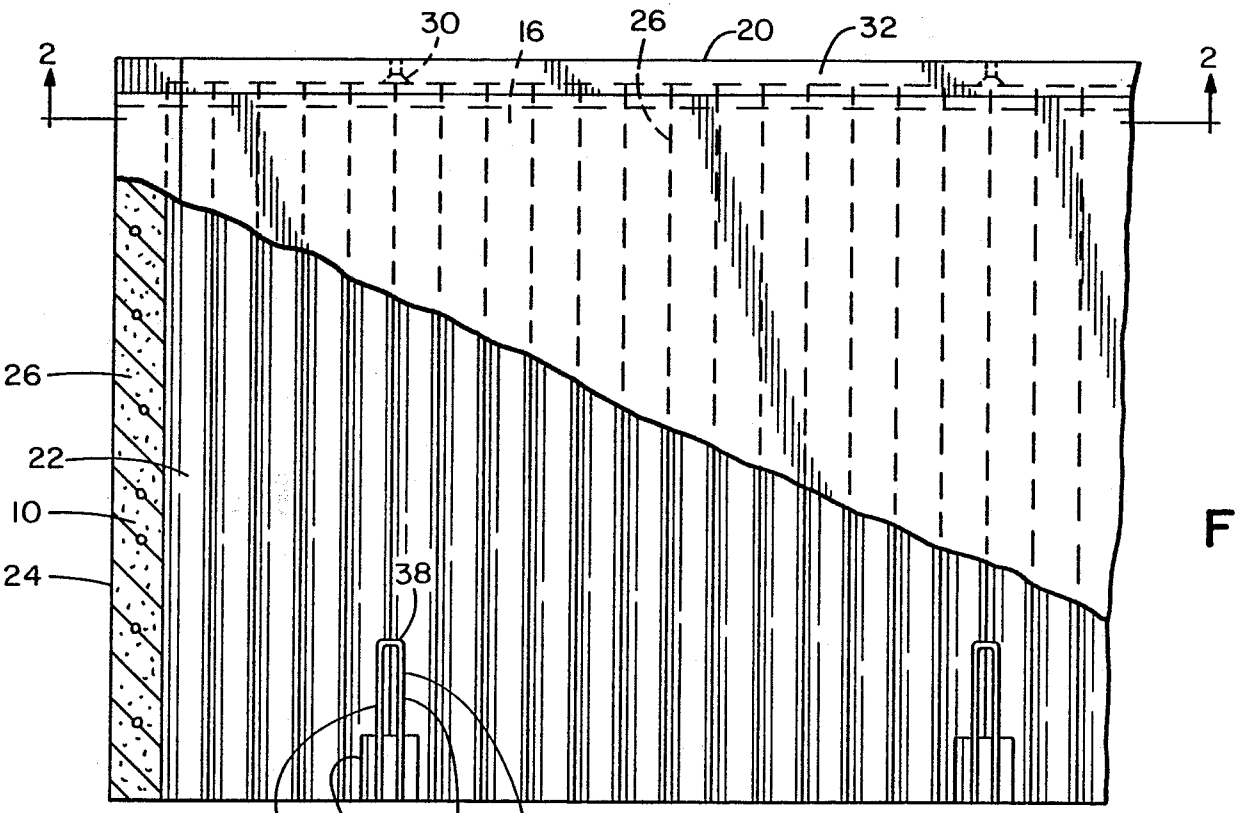
FIG. 1 is a front elevational view, partially in section, of a prefabricated wall panel embodying the features of this invention.
Figure 2:
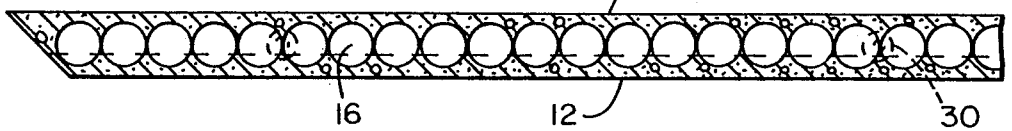
FIG. 2 is a top plan view of the wall panel shown in FIG. 1.
Figure 3:
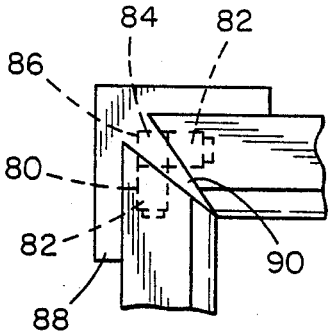
FIG. 3 is a top plan view of a corner section between wall panels of the type shown in FIG. 1, including the corner assembly of the adjacent panels.
Figure 6:
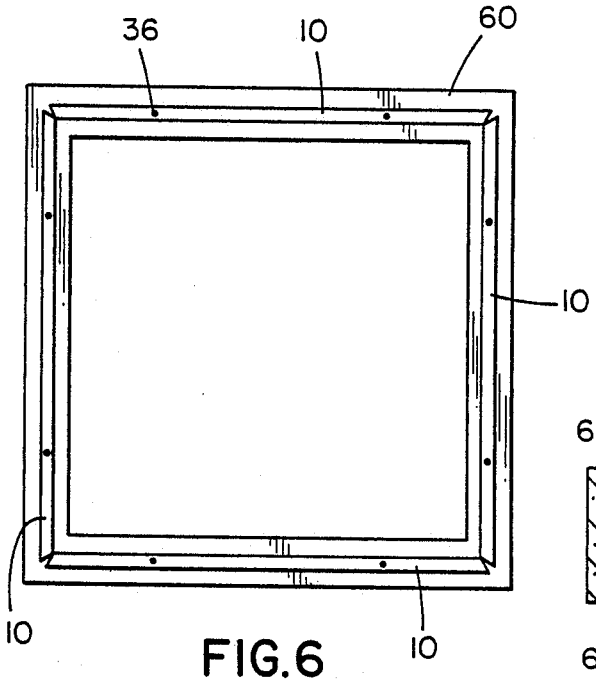
FIG. 6 is a schematic top plan view of the footing and wall panels mounted thereon.

With reference now to the drawings, illustration is made of a monolithic panel 10, formed of concrete or other cementitious material, having a flat inside wall 12 and a flat outside wall 14 in spaced parallel relation with the inside wall 12. The wall is formed with hollow sections 16 extending vertically in a juxtaposition from the bottom 18 of the wall to within a few inches of the top 20 with the outermost hollow section 22 being spaced a short distance from the end walls 24 to provide solid concrete sections 26 at the sides, upper borders and the juxtapositioned hollow sections 16.

Such hollow sections 16, which may be rectangular or other polygonal shape in cross section, but preferably of circular cross section, are effective materially to reduce the amount of material making up the wall section thereby markedly to reduce the cost as well as the weight of the wall. The prefabricated, hollowed monolithic panels described are considerably lighter in weight than solid panels formed to the same dimensions of cementitious materials. Very little, if any, strength characteristics are sacrificed by the fabrication with voids extending substantially throughout the interior of the panel. Thus, the prefabricated hollow panels embodying the features of this invention are capable of easy handling in fabrication and in their assembly to form a wall structure.

For this purpose, the hollow panels of this invention are formed with inserts 30 anchored in spaced apart relation in the solid border portion 32 at the top. The inserts 30 serve as a means for engagement by lifting mechanisms and as means for securing sill plates to the top of the wall. By way of illustration, such inserts 30 can be provided with threaded openings for threaded engagement by bolts adapted to receive clamps or other hook members for lifting the prefabricated panel for movement from place to place, or for conveying the panel to its position of use and support thereof in upright position on the footing until assembly has been completed sufficiently for self-support.

Figure 4:
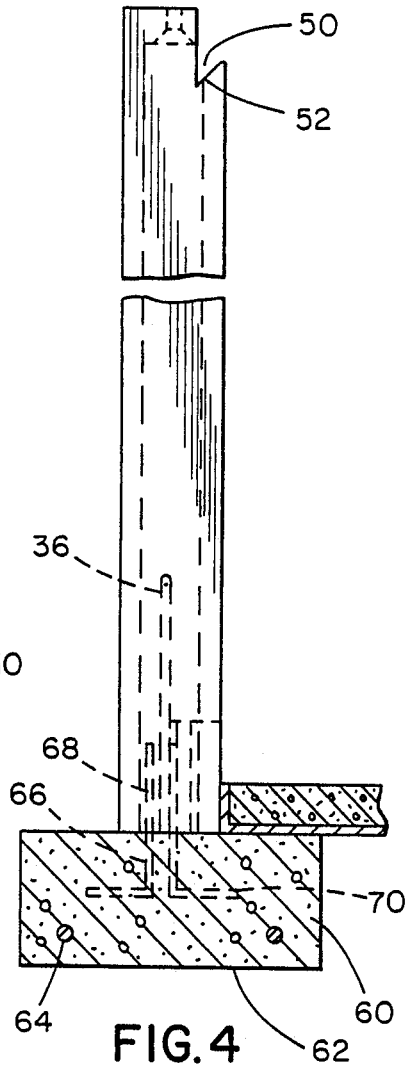
FIG. 4 is an end elevational view of the panel shown in FIG. 1, with a cross section of the footing on which it is mounted.

As illustrated in FIGS. 1 and 4 of the drawings, wall rods 36, preferably of U-shape, are anchored in the prefabricated hollow wall, preferably on 6 to 8 foot centers, beginning about 3 to 4 feet from the end, with the bail portion 38 of the wall rod spanning the wall portion between adjacent hollow sections 16 and with the leg members 40 extending inwardly in the adjacent hollow sections to the bottom of the panel. The bail portion 38 is dimensioned to correspond to the space between the hollow sections so that the legs 40 embrace the solid section of the wall therebetween.

The inside wall 12 is formed with an opening 42, preferably of rectangular shape, alongside the lower end portion of the wall rod 38 to enable access thereto in assembly to secure the wall rod to the footing, as will hereinafter be described.

Though not essential, it is preferred to construct the prefabricated monolithic panel with a groove 50 along the inner upper edge to a depth sufficient to intercept the upper end portions of the voids, with the groove dimensioned to extend continuously across the panel to accommodate electrical wiring and the like cables for concealment in the grooved portion of the wall. Such utilizations are facilitated by forming the groove 50 with a bottom wall 52 that tapers inwardly and downwardly to provide a secure seat in which such cables, wiring, or piping can be secured. Intersection of the groove 50 with the voids provides passage for the wires, cables, piping and the like downwardly through the voids in the panel to the lower portion of the walls where outlets or the like can be located. Thus means are provided for laying and concealing of such wiring, cables, piping and the like in the wall panels, before or after assembly.

Such prefabricated panels can be formed in a mold part in the form of a framework having the shape of the wall panel and laid flat upon a supporting surface, with tubular members supported by suitable elements to extend horizontally lengthwise through the central portion of the mold part in the desired laterally spaced apart parallel relation to extend from the bottom of the wall to within a few inches of the top. A groove forming strip is supported to extend crosswise of the framework in a notch formed in the upper end portion of the tubular members, and the inserts are supported to project into the upper end of the framework in the desired spaced apart relation. Thereafter the concrete is poured into the mold to enclose the tubular members and to fill the mold and thereafter allowed to set. Only the strip is removed to leave the crosswise extending groove 50 at the top which intersects the voids defined by the tubular member.

When it is desired to provide an outside wall having a facing simulating brickwork, stonework, or the like, a template of the desired design is first laid down to form the base of the mold so that the design will be transposed to the cement forming the outer wall portion of the prefabricated panel. Similarly, color can be introduced in the wall either by tinting the cementitious material or by providing a layer of cementitious material forming one or more exposed surfaces of the panel. Thus such designs and colors can be prefabricated into the panel to form an integral part thereof.

As previously described, to form the voids 16, use can be made of tubular members of the desired cross section for casting the cementitious material thereabout. When formed of paper board or the like cellulosic material, it is desirable to make use of treated paper, as with wax or other polymeric material, to render the tubular material substantially impervious to water, thereby to resist penetration of the cementitious material during fabrication of the panel. Such tubular members, formed of low cost cellulosic material, can be allowed to remain to form a part of the prefabricated monolithic wall panel since such lined voids enjoy a higher U-factor for better insulation while avoiding the time and labor for removal from the cured cementitious panel.

In assembly, a cementitious footing 60 is first laid down to provide the base onto which the wall panels are mounted. The footing is formed in the conventional manner by excavating a trench 62 about 2 feet wide and about 10 inches deep, underlying the locations for the outer walls of the structure. The walls of the trench are usually lined with board members and then the cement is poured to fill the trench. Lengthwise and laterally spaced apart reinforcing rods 64 are preferably prepositioned within the trench to become embedded when the cement is poured.

Anchor rods 66 are embedded in the cementitious footing with one portion 68 of the anchor rods extending upwardly to project from the footing while the lower portions 70 of the anchor rods are embedded in the cement for anchoring the rods into the cement. In the illustrated modification the anchor rods comprise a pair of L-shaped members in which the vertically disposed portions 68 are spaced one from the other by an amount corresponding to the cross section of the wall rods 38 and the base portions 70 extend as flange members in the direction away from each other for better anchorage in the footing.

In assembly, the prefabricated wall section 10 is set onto the footing 60 with the anchor rods 68 crosswise aligned with the wall rods 38 so that the wall panel can be displaced inwardly to enable the anchor rods 68 to pass through the openings 42 into the space between the legs 36 and 40 of the U-shaped wall rods 38. While the opening 42 is still available for access to the rods, the wall rods are welded to the anchor rods whereafter the opening can be concealed by a door or cementitious material.

All four of the walls are thus secured in place to define the outer walls of the structure. The mounted panels are secured one to the other at their meeting corners by anchor plates 80, portions 82 of which are embedded in the panel with other portions 84 projecting from the angled side walls during fabrication of the panels, with the plates of one wall at a level differing from the plates in the adjacent corner-forming wall by an amount corresponding to the thickness of, the plate so that the plates projecting from the corner portion of one wall will overlap the plate projecting from the corner portion of the other wall. The adjacent end walls of the panels are formed to angles slightly greater than 45° to define a V-shaped opening 86 therebetween. In assembly, the V-shaped opening 86 between the corner-forming panels enables the overlapping plates 84 to be joined, as by welding or other fastening means. Such pairs of anchoring plates are provided for joinder at the upper and lower portions of the wall panel, but additional plates can be provided for joinder at additional levels.

After joinder of the anchor plates in the corner sections, the V-shaped slots 86 between the adjacent corner-forming walls, can be filled with a corner section 88 in the form of an elongate strip of cement, metal, plastic, wood or the like structural material dimensioned to have a length corresponding to the height of the wall panel and with flanges extending at right angles by an amount to overlap the edge portion of the adjacent panels. Such prefabricated corner-forming section includes a triangular member 90 extending inwardly from the inner corner of the strip, and having a cross section corresponding to the cross section of the V-shaped opening 86 formed at the corner between the panels thereby to enable the corner sections to be inserted to conceal the openings and further tie in the adjacent panels into a strong assembly. The corner section 84 can be cemented or otherwise bonded or secured in place, as by metal fastening means.

Figure 5:
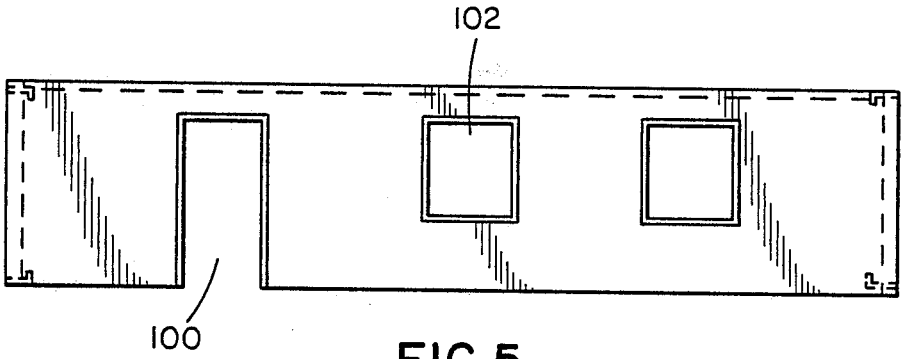
FIG. 5 is a schematic elevational view of a panel showing the windows and door blocked out.

FIG. 5 is given by way of illustration of one of the many ramifications of wall panels that may be prefabricated in accordance with the practice of this invention with one or more door openings 100, window openings 102 and the like provided therein, as by the use of suitable templates to block out such openings in the mold prior to the cement being poured.

It will be apparent from the foregoing that there is provided an improved, light weight, structurally strong, prefabricated wall panel adapted to be assembled in a simple and efficient manner to footings and to each other to define the outer walls of buildings and the like.

It will be understood that changes may be made in the details of construction, arrangement and operation without departing from the spirit of the invention, especially as defined in the following claims.

I claim:

1. A light weight, high strength monolithic panel of cementitious material, said panel being defined by relatively flat front and back walls in spaced parallel relation, side edges in top and bottom edges, elongate voids extending continuously through the interior of the panel in closely spaced parallel relation from the bottom edge to a distance short of the top edge, wall rods of inverted U-shape disposed in laterally spaced apart portions of the panel with the bail portion of each wall rod extending through a portion of the panel between adjacent voids and with the arms of the wall rod extending downwardly through the lower portions of the adjacent voids alongside the portion of the panel between said voids.

2. A light weight panel as claimed in claim 1 in which the wall rods are located in the lower end portions of the panel.

3. A light weight panel as claimed in claim 1 which includes openings through the back wall of the panel alongside the lower end portions of the wall rods for access to the wall rods for anchoring the panel to a foundation.

4. A light weight panel as claimed in claim 3 in which the openings are dimensioned to have a height less than the length of the wall rod and a width greater than the thickness of the space between the adjacent voids up to the width that includes the adjacent voids.

5. A light weight panel as claimed in claim 1 in which the arms of the wall rods extend downwardly from the bail to the bottom edge of the panel.

6. A light weight panel as claimed in claim 1 which includes a cementitious footing, anchor rods embedded within the footing on spaced centers corresponding to the spacing of the wall rods in the panel to be mounted thereon, said anchor rods having portions extending upwardly beyond the top side of the footing in position to be engaged by the arms of the wall rods for attachment thereto.

7. A light weight panel as claimed in claim 6 in which the anchor rods are in the form of L-shaped members with the base portions anchored in the footing and having vertically disposed arm portions extending upwardly for a distance beyond the upper face of the footing for attachment to the wall rods.

8. In a wall structure light weight, high strength monolithic panels of cementitious material, each panel being defined by relatively flat front and back walls in spaced parallel relation, side edges and top and bottom edges, elongate voids extending continuously through the interior of the panel in closely spaced parallel relation from the bottom edge to a distance short of the top edge, in which the side edges of the panels making up a corner portion of the wall extend angularly outwardly from the inner wall to define a V-shaped groove therebetween extending substantially continuously through the height of said adjacent panels, and which includes a corner plate having a wedge shape member contoured to fit the V-shaped groove, and means securing the corner plate to the adjacent panels with the wedge portion extending into the V-shaped groove therebetween.

9. In a wall structure as claimed in claim 8 in which the corner plate has side walls extending at right angles to each other and a wedge-shaped member extending inwardly at an angle of about 45° from the meeting edges of the side walls, said wedge-shaped member being contoured to fit into the V-shaped groove, and means for securing the corner plate with the side walls positioned in abutting relation with the outer walls of the adjacent panels and with the wedge portion extending into the V-shaped groove therebetween.

* * * * *